US007651216B2

(12) United States Patent
Chen et al.

(10) Patent No.: US 7,651,216 B2
(45) **Date of Patent: *Jan. 26, 2010**

(54) FUSIBLE INKJET RECORDING MATERIALS CONTAINING HOLLOW BEADS, SYSTEM USING THE RECORDING MATERIALS, AND METHODS OF USING THE RECORDING MATERIALS

(75) Inventors: Tienteh Chen, San Diego, CA (US); Radha Sen, San Diego, CA (US); Steven L. Webb, Murrieta, CA (US); Anne M. Kelly-Rowley, San Diego, CA (US); Loretta Ann Grezzo Page, San Diego, CA (US); Gary O. Page, legal representative, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 531 days.

This patent is subject to a terminal disclaimer.

(21) Appl. No.: 10/963,097

(22) Filed: Oct. 12, 2004

(65) Prior Publication Data

US 2005/0287313 A1 Dec. 29, 2005

Related U.S. Application Data

(63) Continuation-in-part of application No. 10/875,642, filed on Jun. 24, 2004, now abandoned.

(51) Int. Cl.
*B41J 2/01* (2006.01)

(52) U.S. Cl. ..... 347/105; 347/101; 428/32.1

(58) Field of Classification Search ..... 347/100, 347/101, 102, 105; 428/195, 32.1
See application file for complete search history.

(56) References Cited

U.S. PATENT DOCUMENTS

| | | | | |
|---|---|---|---|---|
| 4,929,590 | A * | 5/1990 | Maruta et al. | 503/207 |
| 5,194,317 | A | 3/1993 | Sato et al. | |
| 6,357,871 | B1 | 3/2002 | Ashida et al. | |
| 6,358,306 | B1 * | 3/2002 | Hanada et al. | 106/287.13 |
| 6,497,480 | B1 * | 12/2002 | Wexler | 347/105 |
| 6,677,007 | B1 * | 1/2004 | Warner et al. | 428/32.34 |
| 2004/0086666 | A1 * | 5/2004 | Yoshimura et al. | 428/32.1 |

FOREIGN PATENT DOCUMENTS

| | | |
|---|---|---|
| EP | 0 671 282 A | 9/1995 |
| EP | 0 967 087 A | 12/1999 |
| JP | 07/276785 A | 10/1995 |
| JP | 2001-191637 | 7/2001 |
| JP | 2002-036718 | 2/2002 |
| JP | 2002-219862 | 8/2002 |

* cited by examiner

*Primary Examiner*—Manish S Shah

(57) ABSTRACT

Briefly described, embodiments of this disclosure include fusible print media, methods of making fusible print media, and systems for preparing a fused ink-jet image. One exemplary embodiment of the fusible print medium, among others, includes a substrate and an ink-receiving layer disposed on the substrate. The ink-receiving layer includes a plurality of hollow polymer beads having substantially the same diameter.

13 Claims, 3 Drawing Sheets

FUSIBLE INKJET RECORDING MATERIALS CONTAINING HOLLOW BEADS, SYSTEM USING THE RECORDING MATERIALS, AND METHODS OF USING THE RECORDING MATERIALS

CROSS-REFERENCE TO RELATED APPLICATION

This application is a continuation-in-part of U.S. utility application entitled, "Fusible Inkjet Recording Materials Containing Hollow Beads, System Using The Recording Materials, And Methods Of Using The Recording Materials," having Ser. No. 10/875,642, filed Jun. 24, 2004, now abandoned which is entirely incorporated herein by reference.

BACKGROUND

The use of inkjet printing in offices and homes has grown dramatically in recent years. The growth can be attributed to drastic reductions in cost of inkjet printers and substantial improvements in print resolution and overall print quality. While the print quality has improved drastically, research and development efforts continue toward further improving the print quality to achieve images having photographic quality. A photographic quality image includes saturated colors, high gloss and gloss uniformity, freedom of grain and coalescence, and a high degree of permanence. To achieve photographic image quality, the print medium must be fast drying and resist smearing, air, light, and moisture. In addition, the print medium should provide good color fidelity and high image resolution.

In order to obtain printed images that dry quickly and have good image quality, durability, and permanence, microporous inkjet print media with thermally laminated barrier layers have been developed. While lamination of the printed image provides very good image quality and permanence, the cost of producing the laminated images is increased due to the cost of the laminator and the additional supplies that are necessary. In addition, lamination produces haze and air bubbles, which become trapped, decreasing the image quality of the printed images.

Print media that are capable of producing images having photographic image quality are typically categorized into two groups: porous media and swellable media. Porous media generally have an ink-receiving layer that is formed from porous, inorganic particles bound with a polymer binder. An ink-jet ink is absorbed into the pores of the inorganic particles and the colorant is fixed by mordants incorporated in the ink-receiving layer or by the surface of the inorganic particles. Porous media have a short dry time and good resistance to smearing because the inkjet ink is easily absorbed into the pores of the ink-receiving layer. However, porous media do not exhibit good resistance to fade.

In swellable media, the ink-receiving layer is a continuous layer of a swellable, polymer matrix. When the inkjet ink is applied, the inkjet ink is absorbed by swelling of the polymer matrix and the colorant is immobilized inside the continuous layer. Since the colorant is protected from the outside environment, swellable media have greater resistance to light and dark/air fade than the porous media. However, the swellable media generally have reduced smearfastness and a longer drytime than porous media.

SUMMARY

Briefly described, embodiments of this disclosure include fusible print media, methods of making fusible print media, and systems for preparing a fused ink-jet image. One exemplary embodiment of the fusible print medium, among others, includes a substrate and an ink-receiving layer disposed on the substrate. The ink-receiving layer includes a plurality of hollow polymer beads having substantially the same diameter.

One exemplary embodiment of the method of preparing fused ink-jet image, among others, includes: providing a fusible print medium; dispensing an ink onto the fusible print medium; and fusing the fusible print medium after dispensing the ink onto the fusible print medium. The fusible print medium can include a substrate and an ink-receiving layer disposed on the substrate. The ink-receiving layer includes a plurality of hollow beads having substantially the same diameter.

One exemplary embodiment of the system for preparing a fused ink-jet image, among others, includes: a fusible print medium, an ink dispensing system configured to print ink onto the fusible print medium, and a fuser system configured to fuse the fusible print medium after dispensing ink onto the fusible print medium. The fusible print medium can include a substrate and an ink-receiving layer disposed on the substrate. The ink-receiving layer includes a plurality of hollow beads having substantially the same diameter.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Fusible print media and systems using fusible print media are described. Embodiments of the present disclosure enhance the gloss, gamut, durability, water fastness, fading (due to air pollutants), and ink absorbtivity relative to currently known media. The fusible print medium can include, but is not limited to, a substrate having an ink-receiving layer. The ink-receiving layer can include, but is not limited to, a plurality of hollow beads and a binder. In another embodiment, the ink-receiving layer includes a mordant. After disposing the ink (e.g., pigment-based inkjet inks and/or dye-based inkjet inks) onto the ink-receiving layer, the fusible print medium is fused. Upon fusing the fusible print medium the hollow beads are substantially compressed (e.g., reducing the void volume of the hollow beads), which fuses the ink within the ink-receiving layer.

Figure 1:
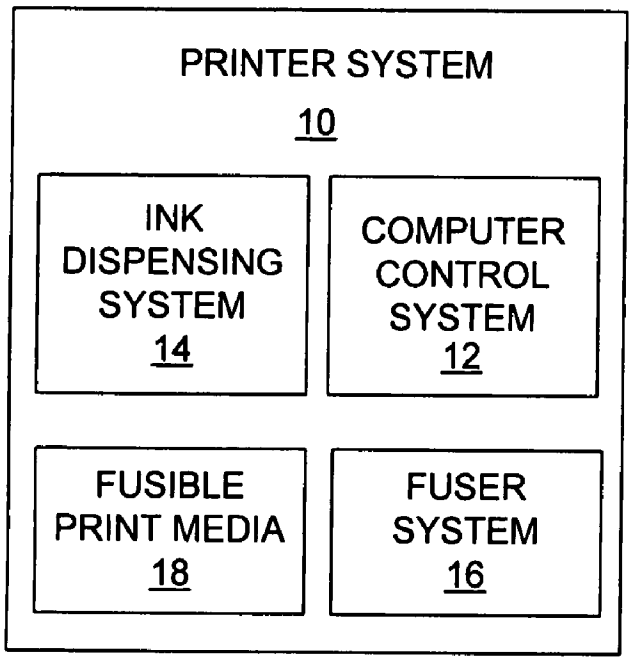
FIG. 1 illustrates an embodiment of a printer system.

FIG. 1 illustrates a block diagram of a representative printer system 10 that includes a computer control system 12, ink dispensing system 14, fuser system 16 and fusible print medium 18. The computer control system 12 includes a process control system that is operative to control the ink dispensing system 14 and the fuser system 16. In particular, the computer control system 12 instructs and controls the ink dispensing system 14 to print characters, symbols, photos, and the like, onto the fusible print medium 18. In addition, the computer control system 12 instructs and controls the fuser system 16 to fuse the fusible print medium 18 after printing.

The ink dispensing system 14 includes, but is not limited to, ink-jet technologies and coating technologies, which dispense the ink onto the fusible print medium. Ink-jet technology, such as drop-on-demand and continuous flow ink-jet technologies, can be used to dispense the ink. The ink dispensing system 14 can include at least one ink-jet printhead (e.g., thermal ink-jet printhead and/or a piezo ink-jet print head) operative to dispense (e.g., jet) the inks through one or more of a plurality of ink-jet printhead dispensers.

Figure 2:
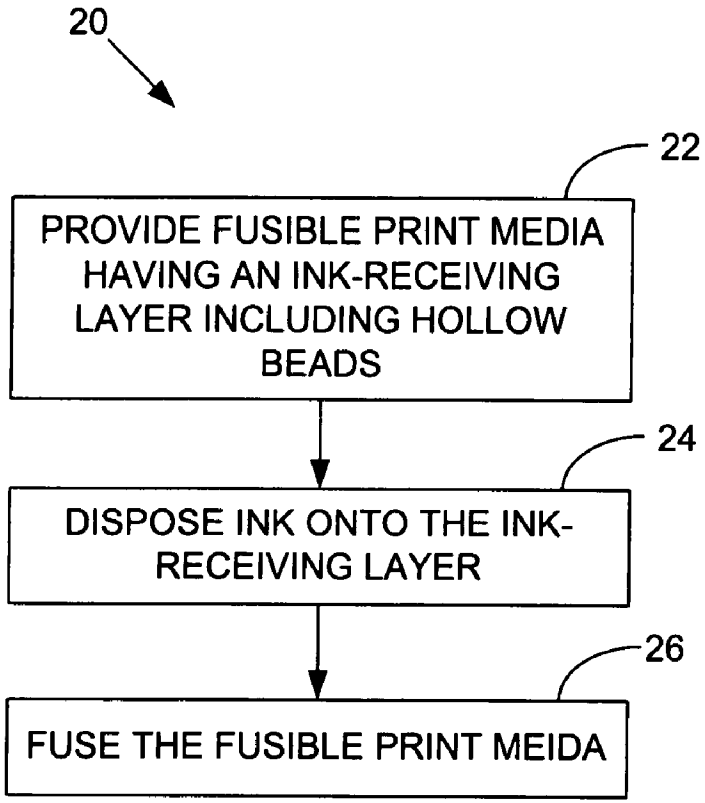
FIG. 2 illustrates a flow diagram of a representative embodiment for using fusible print medium having an ink-receiving layer including hollow beads.

FIG. 2 is a flow diagram describing a representative method 20 for printing on fusible print medium using the printer system 10. In block 22, the fusible print medium having an ink-receiving layer including hollow bead is provided. In block 24, the ink is disposed onto the ink-receiving layer of the fusible print medium 18 using the ink dispensing system 14. In block 26, the fusible print medium is fused by the fuser system 16 after being printed.

Figure 3:
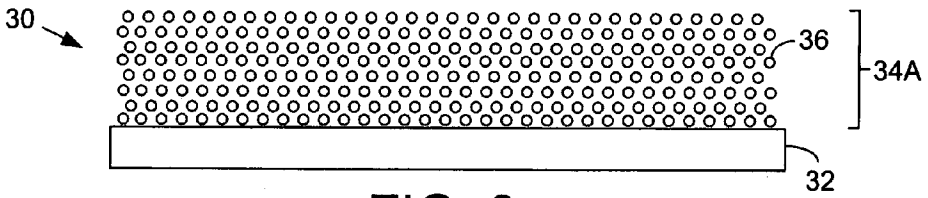
FIG. 3 illustrates a cross-sectional view of a representative embodiment of fusible print medium having an ink-receiving layer including hollow beads.

FIG. 3 illustrates a cross-sectional view of a representative embodiment of the fusible print medium 30. As mentioned above, the fusible print medium 30 can include, but is not limited to, a substrate 32 having ink-receiving layer 34A. The ink-receiving layer can include, but is not limited to, a plurality of hollow beads 36 and a binder (not shown for clarity).

The term "substrate" 32 refers to fusible print medium substrates that can be coated with the ink-receiving layer 34A in accordance with embodiments of the present disclosure. The substrate 32 can include, but is not limited to, a paper medium, a photobase medium, a plastic medium such as clear to opaque plastic film, and the like. The substrate 32 may include, but is not limited to, a hard or flexible material made from a polymer, a paper, a glass, a ceramic, a woven cloth, or a non-woven cloth material. The substrate 32 may be from about 2 mm to about 12 mm thick, depending on a desired end application for the fusible print medium 30.

The term "ink-receiving layer" 34A refers to compositions that include hollow beads that can be disposed (e.g., coated) on the fusible print medium substrate 32. The ink-receiving layer 34A is configured to receive ink within the pores provided by the hollow beads 36, and by the space between the hollow beads 36. In addition, the ink-receiving layer 34A also includes binder material used to bind the hollow beads 36 together.

The binder materials can include, but are not limited to, water soluble polymers (e.g., polyvinyl alcohol, cationic polyvinylalcohol, acetoacetylated polyvinylalcohol, silylated polyvinylalcohol, carboxylated polyvinylalcohol, polyvinylpyrrolidone, copolymer of polyvinylacetate and polyvinylpyrrolidone, copolymer of polyvinylalcohol and polyvinylpyrrolidone, cationic polyvinylpyrrolidone, gelain, hydroxyethylcellulose, methyl cellulose), water dispersible polymers, gelatin, and/or low glass transition temperature (Tg<20° C.) emulsion polymers (e.g., styrene butadiene latex, styrene acrylic latex, vinyl acrylic latex, all acrylic latex, polyurethane dispersions, and polyester dispersions).

An amount of binder can be used that functionally binds together the hollow beads, but still leaves space between and within the hollow beads 36 such that ink can be received within the ink receiving layer upon printing. Appropriate ratios can provide ink-receiving layers that avoid unwanted cracking upon drying, and at the same time, provide hollow bead to hollow bead adhesion within the ink-receiving layer while maintaining voids within and around the hollow beads. For example, the ink-receiving layer 34A can include greater than about 70% hollow beads 36. The ink-receiving layer 34A can be from about 10 to 50 grams per square meter (GSM) and from about 10 to 30 GSM.

The term "hollow bead" 36 refers to hollow plastic pigments and the like that include one or more void(s) within the outer dimension of the pigment volume. The hollow beads 36 can have a void volume from 20% to 70% and 30% to 60%. In addition, the hollow beads 36 can have a diameter from about 0.3 to 10 μm, about 0.3 to 5 μm, and about 0.3 to 2 μm. Further, the hollow beads 36 can have a glass transition temperature (Tg) above about 50° C., above about 70° C., above about 90° C., from about 50° C. to 120° C., from about 50° C. to 120° C., from about 70° C. to 120° C., and from about 90° C. to 120° C. Furthermore, the hollow beads 36 used for a particular application have substantially the same diameter.

The hollow beads 36 can be derived from chemicals such as, but are not limited to, acid monomers, non-ionic monoethylenically unsaturated monomers, and polyethylenically unsaturated monomer. The acid monomers can include, but are not limited to, acrylic acid, methacrylic acid, and mixtures thereof; and acryloxypropionic acid, methacryloxypropionic acid, acryloxyacetic acid, methacryloxyacetic acid, and monomethyl acid itaconate. The noionic monoethylenically unsaturated monomers can include, but are not limited to, styrene and styrene derivatives (e.g. alkyl, chloro- and bromo-containing styrene), vinyltoluene, ethylene, vinyl esters (e.g. vinyl acetate, vinylformate, vinylacetate, vinylpropionate, vinylbenzoate, vinylpivalate, vinyl 2-ethylhexanoate, vinyl methacrylate, vinyl neodecanoate, and vinyl neononanoate), vinyl versatate, vinyl laurate, vinyl stearate, vinyl myristate, vinyl butyrate, vinyl valerate, vinyl chloride, vinylidene chloride, acrylonitrile, methacrylonitrile, acrylamide, (meth) acrylamide, t-butylacrylamide, t-butyl methacrylamide, isopropylarylamide, isopropylmethacrylamide, and $C_1$-$C_{20}$ alkyl or $C_3$-$C_{20}$ alkenyl esters of (meth)acrylic acid.

The expression (meth)acrylic acid is intended to serve as a generic expression embracing both acrylic acid and methacrylic acid (e.g., methyl methacrylate, t-butylmethacrylate, methyl acrylate, ethyl (meth)acrylate, butyl (meth)acrylate, 2-ethylhexyl (meth)acrylate, benzyl (meth)acrylate, lauryl (meth)acrylate, oleyl (meth)acrylate, palmityl (meth)acrylate, stearyl (meth)acrylate, hydroxyl containing (meth)acrylate, (e.g., hydroxyethylacrylate, hydroxyethylmethacrylate, hydroxypropylacrylate, hydroxypropylmethacrylate, and 2,3-Dihydroxypropyl methacrylate)). Polyethylenically unsaturated monomers can include, but are not limited to, ethylene glycol di(meth)acrylate, allyl (meth)acrylate, 1,3-butane-diol di(meth)acrylate, diethylene glycol di(meth) acrylate, trimethylol propane trimethacrylate, and divinyl benzene.

In particular, the hollow beads 36 can include, but are not limited to, an acrylic or styrene acrylic emulsion, such as Ropaque® HP-543, Ropaque® HP-643, Ropaque®

HP-1055, or Ropaque® OP-96 (available from Rohm and Haas Co. (Philadelphia, Pa.)) or Dow HS 2000NA, Dow 3000NA, Dow 3020NA, or Dow 3042NA (available from Dow Chemical Co. (Midland, Mich.)).

The term "fuse," "fusion," "fusing," or the like, refers to the state of a printed character, symbol, and/or image (or the process of obtaining a printed image) that has been at least partially melted such that the ink-receiving layer 34A forms a film that protects the ink printed therein or thereon. Fusion can occur by applying heat and/or pressure, and preferably both, to the fusible print medium after being printed. Due to the application of heat, and optionally, pressure, the ink-receiving layer becomes compressed and fused. The amount of heat and/or pressure applied depends, at least in part, on the materials used, but generally, can be from 100° C. to 250° C. and/or from 50 pounds per square ink (psi) to 300 psi, respectively.

Figure 4A:
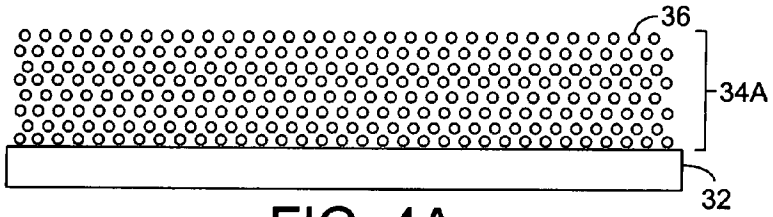
FIGS. 4A through 4C are cross-sectional views of a series of schematic diagrams illustrating the dispensing of a pigment-based ink onto the representative embodiment of the fusible print medium shown in FIG. 3 and the fusing of the print medium.
Figure 4B:
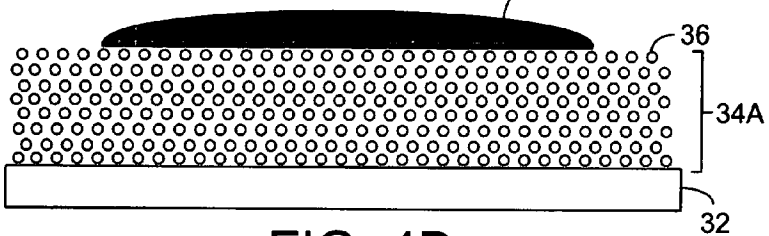
Figure 4C:
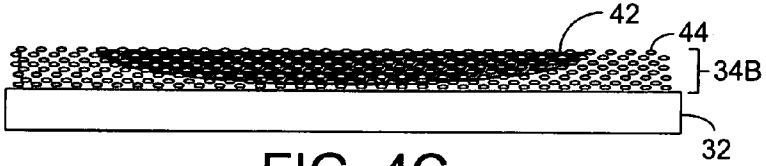

FIGS. 4A through 4C are cross-sectional views of a series of schematic diagrams illustrating dispensing a pigment-based ink 42 onto the fusible print medium 30 shown in FIG. 3 and the fusing of the fusible print medium 30. In FIG. 4A illustrates the fusible print medium 30, while FIG. 4B illustrates pigment-based ink 42 disposed upon the ink-receiving layer 34A by the ink dispenser system 14. FIG. 4C illustrates the fusing of the fusible print medium 30. The ink-receiving layer 34B has been compressed (e.g., compressed hollow beads 44) due to the heat and/or pressure applied by the fuser system 16. The compressed ink-receiving layer 34B protects the pigment-based ink 42 printed onto the fusible print medium 30.

Figure 5A:
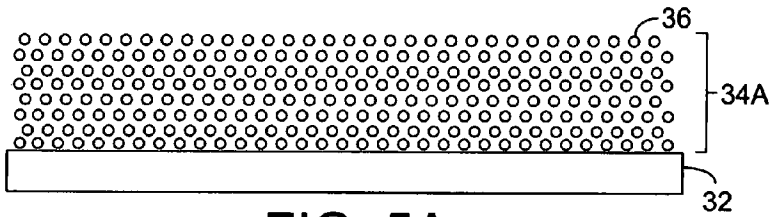
FIGS. 5A through 5C are cross-sectional views of a series of schematic diagrams illustrating the dispensing of a dye-based ink onto the representative embodiment of the fusible print medium shown in FIG. 3 and the fusing of the print medium.
Figure 5B:
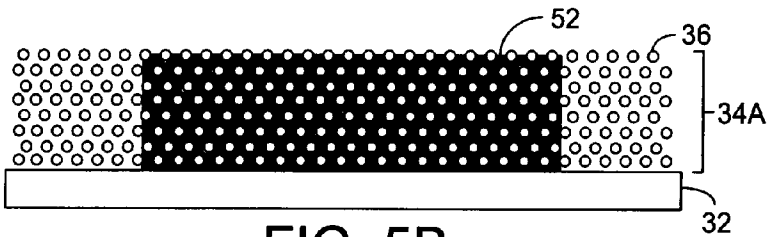
Figure 5C:
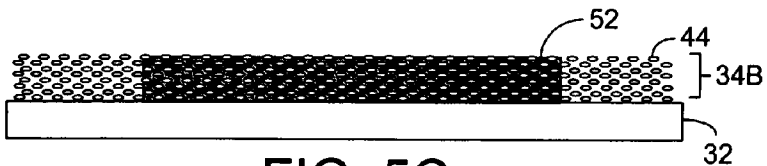

FIGS. 5A through 5C are cross-sectional views of a series of schematic diagrams illustrating dispensing a dye-based ink 52 onto the fusible print medium 30 shown in FIG. 3 and the fusing of the fusible print medium 30. In FIG. 5A illustrates the fusible print medium 30, while FIG. 4B illustrates dye-based ink 52 disposed upon and within the ink-receiving layer 34A by the ink dispenser system 14. FIG. 5C illustrates the fusing of the fusible print medium 30. The ink-receiving layer 34B has been compressed (e.g., compressed hollow beads 44) due to the heat and/or pressure applied by the fuser system 16. The compressed ink-receiving layer 34B protects the dye-based ink 52 printed onto the fusible print medium 30.

Figure 6:
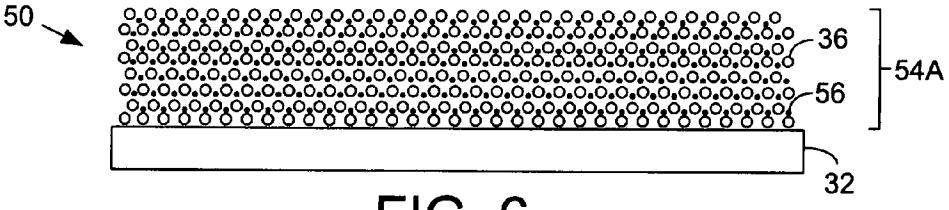
FIG. 6 illustrates a cross-sectional view of a representative embodiment of fusible print media having an ink-receiving layer including hollow beads and a mordant.

FIG. 6 illustrates a cross-sectional view of a representative embodiment of fusible print medium 50. The fusible print medium 50 can include, but is not limited to, a substrate 32 having ink-receiving layer 54A. The ink-receiving layer 54A can include, but is not limited to, a plurality of hollow beads 36, a mordant 56, and a binder (not shown for clarity).

The mordant 56 chemically interacts (e.g., ionically bonds) with the dye-based ink. In particular, cationic mordant ionically bonds with anionic dye-based ink. The mordant may be a cationic polymer such as, but not limited to, a polymer having a primary amino group, a secondary amino group, a tertiary amino group, a quaternary ammonium salt group, or a quaternary phosphonium salt group. The mordant may be in a water-soluble form or in a water-dispersible form, such as in latex. The water-soluble cationic polymer can include, but is not limited to, a polyethyleneimine; a polyallylamine; a polyvinylamine; a dicyandiamide-polyalkylenepolyamine condensate; a polyalkylenepolyamine-dicyandiamideammonium condensate; a dicyandiamide-formalin condensate; an addition polymer of epichlorohydrin-dialkylamine; a polymer of diallyldimethylammoniumchloride ("DADMAC"); a copolymer of diallyldimethylammoniumchloride-$SO_2$, polyvinylimidazole, polyvinypyrrolidone; a copolymer of vinylimidazole, polyamidine, chitosan, cationized starch, polymers of vinylbenzyltrimethylqammoniumchloride, (2-methacryloyloxyethyl)trimethyl-ammoniumchloride, and polymers of dimethylaminoethylmethacrylate; or a polyvinylalcohol with a pendant quaternary ammonium salt. Examples of the water-soluble cationic polymers that are available in latex form and are suitable as mordants include, but are not limited to, TruDot P-2604, P-2606, P-2608, P-2610, P-2630, and P-2850 (available from MeadWestvaco Corp. (Stamford, Conn.)) and Rhoplex® Primal-26 (available from Rohm and Haas Co. (Philadelphia, Pa.)), WC-71 and WC-99 from PPG (Pittsburgh, Pa.). It is also contemplated that cationic polymers having a lesser degree of water-solubility may be used in the ink-receiving layer by dissolving them in a water-miscible organic solvent.

A metal salt may also be used as the mordant and can include, but is not limited to, a salt of an organic or inorganic acid, an organic metal compound, and a metal complex. In one embodiment, an aluminum salt may be used since aluminum salts are inexpensive and provide the desired properties in the ink-receiving layer. The aluminum salt can include, but is not limited to, aluminum fluoride, hexafluoroaluminate (e.g., potassium salts), aluminum chloride, basic aluminum chloride (e.g., polyaluminum chloride), tetrachloroaluminate (e.g., sodium salts thereof), aluminum bromide, tetrabromoaluminate (e.g., potassium salts thereof), aluminum iodide, aluminate (e.g., sodium salts, potassium salts, and calcium salts thereof), aluminum chlorate, aluminum perchlorate, aluminum thiocyanate, aluminum sulfate, basic aluminum sulfate, aluminum sulfate potassium (alum), ammonium aluminum sulfate (ammonium alum), sodium sulfate aluminum, aluminum phosphate, aluminum nitrate, aluminum hydrogenphosphate, aluminum carbonate, polyaluminum sulfate silicate, aluminum formate, aluminum diformate, aluminum triformate, aluminum acetate, aluminum lactate, aluminum oxalate, aluminum isopropionate, aluminum butyrate, ethyl acetate aluminum diisopropionate, aluminum tris(acrylacetonate), aluminum tris(ethylacetoacetate), and aluminum monoacetylacetonate-bis(ethylacetoacetate). Preferably, the mordant is a quaternary ammonium salt such as, but not limited to, a DADMAC derivative; an aluminum salt (e.g., aluminum triformate or aluminum chloride hydrate; and a cationic latex that includes quaternary ammonium functional groups (e.g., TruDot P-2608). These chemicals are available from numerous sources, such as BASF Corp. (Mount Olive, N.J.), Ciba Specialty Chemicals (Basel, Switzerland), and MeadWestvaco Corp. (Stamford, Conn.).

Figure 7A:
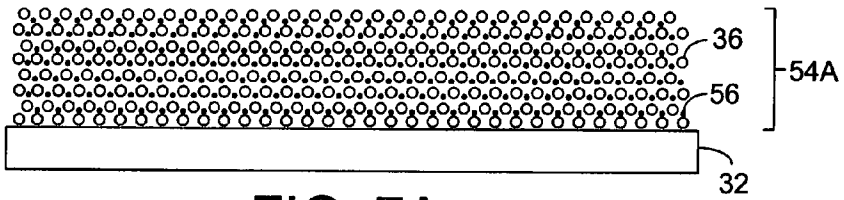
FIGS. 7A through 7C are cross-sectional views of a series of schematic diagrams illustrating the dispensing a dye-based ink onto the fusible print medium shown in FIG. 6 and the fusing of the print medium.
Figure 7B:
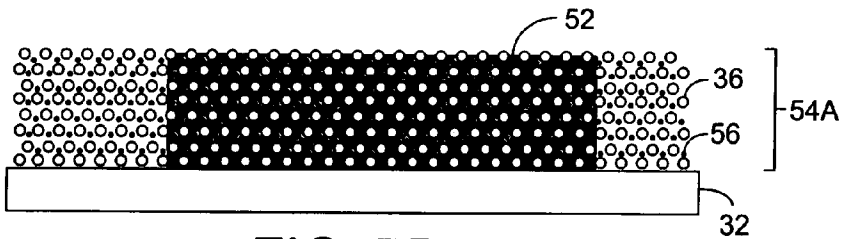
Figure 7C:
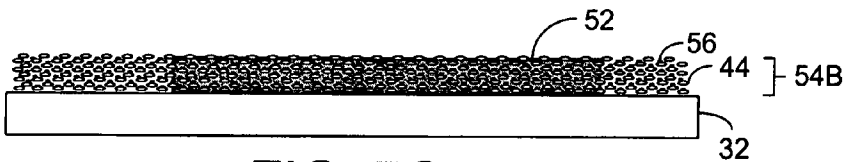

FIGS. 7A through 7C are cross-sectional views of a series of schematic diagrams illustrating dispensing a dye-based ink 52 onto the fusible print medium 50 shown in FIG. 6 and the fusing of the fusible print medium 30. In FIG. 7A illustrates the fusible print medium 50, while FIG. 7B illustrates dye-based ink 52 disposed upon and within the ink-receiving layer 54A by the ink dispenser system 14. FIG. 5C illustrates the fusing of the fusible print medium 50. The ink-receiving layer 54B has been compressed due (e.g., compressed hollow beads 44) to the heat and/or pressure applied by the fuser system 16. The compressed ink-receiving layer 54B protects the dye-based ink 52 printed onto the fusible print medium 30.

In some embodiments the ink-receiving layer 34A and 54A may include microporous and/or mesoporous inorganic particles having a large surface area. The microporous and/or mesoporous inorganic particles may be bound in a polymer binder to form the ink-receiving layer 34A and 54A. The microporous and/or mesoporous inorganic particles may include, but are not limited to, silica, silica-magnesia, silicic acid, sodium silicate, magnesium silicate, calcium silicate, alumina, alumina hydrate, barium sulfate, calcium sulfate, calcium carbonate, magnesium carbonate, magnesium oxide, kaolin, talc, titania, titanium oxide, zinc oxide, tin oxide, zinc carbonate, pseudo-boehmite, bentonite, hectorite, clay, and mixtures thereof. The ink-receiving layer 34A and 54A may be from approximately 1 μm to approximately 300 μm thick.

In some embodiments the ink-receiving layer 34A and 54A may also include non-hollow polymer particles to modify the physical properties of the ink-receiving layer 34A and 54A. The composition of the non-hollow polymer particle can be the same as hollow particles except there is no void inside the particles. The morphology of the non-hollow particles can be homogenous or core-shell. The $T_g$ of the non-hollow particles can be from about 0 to 120° C. and preferably from about 50 to 100° C. The particle size of the non-hollow particles can be from about 0.2 to 5 μm and preferably from 0.2 to 1 μm. The non-hollow polymer particles can include, but are not limited to, styrene compounds, styrene acrylic compounds, all acrylic compounds, vinylacrylic compounds, vinylacetate latex compounds, and combinations thereof.

The dyes that can be used with embodiments of this disclosure include a large number of water-soluble acid and direct dyes. Specific examples of such dyes include the Pro-Jet series of dyes available from Avecia Ltd., including Pro-Jet Yellow I (Direct Yellow 86), Pro-Jet Magenta I (Acid Red 249), Pro-Jet Cyan I (Direct Blue 199), Pro-Jet Black I (Direct Black 168), and Pro-Jet Yellow 1-G (Direct Yellow 132); Aminyl Brilliant Red F-B (Sumitomo Chemical Co.); the Duasyn line of "salt-free" dyes available from Hoechst, such as Duasyn Direct Black HEF-SF (Direct Black 168), Duasyn Black RL-SF (Reactive Black 31), Duasyn Direct Yellow 6G-SF VP216 (Direct Yellow 157), Duasyn Brilliant Yellow GL-SF VP220 (Reactive Yellow 37), Duasyn Acid Yellow XX-SF VP413 (Acid Yellow 23), Duasyn Brilliant Red F3B-SF VP218 (Reactive Red 180), Duasyn Rhodamine B-SF VP353 (Acid Red 52), Duasyn Direct Turquoise Blue FRL-SF VP368 (Direct Blue 199), and Duasyn Acid Blue AE-SF VP344 (Acid Blue 9); mixtures thereof; and the like. Further examples include Tricon Acid Red 52, Tricon Direct Red 227, and Tricon Acid Yellow 17 (Tricon Colors Incorporated), Bemacid Red 2BMN, Pontamine Brilliant Bond Blue A, BASF X-34, Pontamine, Food Black 2, Catodirect Turquoise FBL Supra Conc. (Direct Blue 199, Carolina Color and Chemical), Special Fast Turquoise 8GL Liquid (Direct Blue 86, Mobay Chemical), Intrabond Liquid Turquoise GLL (Direct Blue 86, Crompton and Knowles), Cibracron Brilliant Red 38-A (Reactive Red 4, Aldrich Chemical), Drimarene Brilliant Red X-2B (Reactive Red 56, Pylam, Inc.), Levafix Brilliant Red E-4B (Mobay Chemical), Levafix Brilliant Red E-6BA (Mobay Chemical), Pylam Certified D&C Red #28 (Acid Red 92, Pylam), Direct Brill Pink B Ground Crude (Crompton & Knowles), Cartasol Yellow GTF Presscake (Sandoz, Inc.), Tartrazine Extra Conc. (FD&C Yellow #5, Acid Yellow 23, Sandoz, Inc.), Catodirect Yellow RL (Direct Yellow 86, Carolina Color and Chemical), Cartasol Yellow GTF Liquid Special 110 (Sandoz, Inc.), D&C Yellow #10 (Yellow 3, Tricon), Yellow Shade 16948 (Tricon), Basacid Black X34 (BASF), Carta Black 2GT (Sandoz, Inc.), Neozapon Red 492 (BASF), Orasol Red G (Ciba-Geigy), Direct Brilliant Pink B (Crompton-Knolls), Aizen Spilon Red C-BH (Hodagaya Chemical Company), Kayanol Red 3BL (Nippon Kayaku Company), Levanol Brilliant Red 3BW (Mobay Chemical Company), Levaderm Lemon Yellow (Mobay Chemical Company), Aizen Spilon Yellow C-GNH (Hodagaya Chemical Company), Spirit Fast Yellow 3G, Sirius Supra Yellow GD 167, Cartasol Brilliant Yellow 4GF (Sandoz), Pergasol Yellow CGP (Ciba-Geigy), Orasol Black RL (Ciba-Geigy), Orasol Black RLP (Ciba-Geigy), Savinyl Black RLS (Sandoz), Dermacarbon 2GT (Sandoz), Pyrazol Black BG (ICI Americas), Morfast Black Conc A (Morton-Thiokol), Diazol Black RN Quad (ICI Americas), Orasol Blue GN (Ciba-Geigy), Savinyl Blue GLS (Sandoz, Inc.), Luxol Blue MBSN (Morton-Thiokol), Sevron Blue 5GMF (ICI Americas), and Basacid Blue 750 (BASF); Levafix Brilliant Yellow E-GA, Levafix Yellow E2RA, Levafix Black EB, Levafix Black E-2G, Levafix Black P-36A, Levafix Black PN-L, Levafix Brilliant Red E6BA, and Levafix Brilliant Blue EFFA, all available from Bayer; Procion Turquoise PA, Procion Turquoise HA, Procion Turquoise Ho5G, Procion Turquoise H-7G, Procion Red MX-5B, Procion Red H8B (Reactive Red 31), Procion Red MX 8B GNS, Procion Red G, Procibn Yellow MX-8G, Procion Black H-EXL, Procion Black P-N, Procion Blue MX-R, Procion Blue MX-4GD, Procion Blue MX-G, and Procion Blue MX-2GN, all available from ICI Americas; Cibacron Red F-B, Cibacron Black BG, Lanasol Black B, Lanasol Red 5B, Lanasol Red B, and Lanasol Yellow 46, all available from Ciba-Geigy; Baslien Black P-BR, Baslien Yellow EG, Baslien Brilliant Yellow P-3GN, Baslien Yellow M-6GD, Baslien Brilliant Red P-3B, Baslien Scarlet E-2G, Baslien Red E-B, Baslien Red E-7B, Baslien Red M-5B, Baslien Blue E-R, Baslien Brilliant Blue P-3R, Baslien Black P-BR, Baslien Turquoise Blue P-GR, Baslien Turquoise M-2G, Baslien Turquoise E-G, and Baslien Green E-6B, all available from BASF; Sumifix Turquoise Blue G, Sumifix Turquoise Blue H-GF, Sumifix Black B, Sumifix Black H-BG, Sumifix Yellow 2GC, Sumifix Supra Scarlet 2GF, and Sumifix Brilliant Red 5BF, all available from Sumitomo Chemical Company; Intracron Yellow C-8G, Intracron Red C-8B, Intracron Turquoise Blue GE, Intracron Turquoise HA, and Intracron Black RL, all available from Crompton and Knowles, Dyes and Chemicals Division; mixtures thereof, and the like. This list is intended to be merely exemplary, and should not be considered limiting.

Various buffering agents or pH adjusting agents can also be optionally used in the ink compositions of the present disclosure. Typical buffering agents include such pH control solutions as hydroxides of alkali metals and amines, such as lithium hydroxide, sodium hydroxide, potassium hydroxide; citric acid; amines such as triethanolamine, diethanolamine, and dimethylethanolamine; hydrochloric acid; and other basic or acidic components which do not substantially interfere with the bleed control or optical density characteristics of the present invention. If used, buffering agents typically comprise less than about 10 wt % of the ink composition.

Various biocides can be used to inhibit growth of undesirable microorganisms. Several non-limiting examples of suitable biocides include benzoate salts, sorbate salts, commercial products such as NUOSEPT (Nudex, Inc., a division of Huls America), UCARCIDE (Union Carbide), VANCIDE (RT Vanderbilt Co.), and PROXEL (ICI Americas) and other known biocides. Typically, such biocides comprise less than about 5 wt % of the ink composition and often from about 0.1 wt % to about 0.25 wt %.

Surfactants can also be present, such as alkyl polyethylene oxides, alkyl phenyl polyethylene oxides, polyethylene oxide (PEO) block copolymers, acetylenic PEO, PEO esters, PEO amines, PEO amides, and dimethicone copolyols can be used. If used, such surfactants can be present at from 0.01% to about 10% by weight of the ink composition.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

EXAMPLES 1

Comparison of Image Quality of High $T_g$ Unfused Hollow and Non-Hollow Particles Using Pigment-Based-Ink:

TABLE 1

Formulation Table of Hollow and Non-Hollow Particles as Fusible Inkjet Receivers

| | Particles (100 parts) | Binders | Binders (parts) | % Solid | Ink Absorption Rate 10 GSM | Ink Absorption Rate 20 GSM | Coalescence | Bleed |
|---|---|---|---|---|---|---|---|---|
| 1* | Ropaque HP-643P | Rovene 4151 | 10 | 30 | 3 | 4 | 4 | 5 |
| 2* | Ropaque HP-543P | Rovene 4150 | 10 | 30 | 5 | 5 | 4 | 5 |
| 3* | Ropaque OP-96 | Celvol 523 | 10 | 25 | 3 | 5 | 5 | 5 |
| 4* | Dow HS2000NA | Celvol 523 | 10 | 22 | 5 | 5 | 5 | 5 |
| 5* | Dow HS3000NA | Celvol 523 | 10 | 23 | 5 | 5 | 5 | 5 |
| 6 | SAC 883C | Celvol 523 | 10 | 20 | 1 | 1 | 1 | 1 |
| 7 | SAC 864D | Celvol 523 | 10 | 20 | 3 | 4 | 2 | 2 |
| 8 | Rovene 4106 | Celvol 523 | 10 | 20 | 2 | 2 | 1 | 1 |
| 9 | Phoplex B-88 | Celvol 523 | 10 | 20 | 1 | 2 | 3 | 3 |
| 10 | Phoplex GL-623 | Celvol 523 | 10 | 20 | 2 | 3 | 3 | 3 |
| 11 | Joncryl 1908 | Celvol 523 | 10 | 20 | 1 | 1 | 1 | 1 |
| 12 | Joncryl 2153 | Celvol 523 | 10 | 20 | 1 | 1 | 1 | 1 |

*1-5 are embodiments of the disclosure, while 6-12 are control examples

**SAC 883C and 864D are products of Rohm-Haas Chemical Company. Rovene is trademark of Mallard Creek Polymers. Joncryl is trademark of S.C. Johnson Company. Celvol is trademark of Celanese Chemical Company.

The particle dispersions in Table 1 were mixed with binders and enough deionized water to adjust their total percent solid. The final % solid was adjusted so that the final viscosity of the fluids is within the desirable range for good hand drawdown. The mixture was stirred at ambient temperature with lab stirrer for 30 minutes until the mixture was well mixed. The coating fluid obtained was coated on a 200 g off-set paper (Zanders Ikono Gloss 200) with a wired rod (so called Mylar rod) to give desirable coatweight (about 20 gram/$m^2$). The coating was carefully dried with a heat gun to prevent the premature fusing of the coating. A test plot was printed on using these dry coatings with an Epson C-80 pigment printer. The print quality such as ink absorption rate, coalescence and bleed (intercolor mixing) was inspected visually in 1 to 5 scale (1 is worst, 5 is best). It is clear from Table 1 that unfused inkjet medium comprising high $T_g$ hollow particles have much better image quality than that of non-hollow particles for pigmented ink.

EXAMPLE 2

Comparison of Fused and Unfused Hollow Particle Inkjet Media Printed with Pigment-Based-Ink:

TABLE 2

Formulation and Evaluation of Hollow Particle Receivers for Fusing Study (pigment-based-ink)

| Hollow Particles | X-linker | Binders | Gamut Volume Unfused | Gamut Volume Fused | Gloss (Red, 20°) Unfused | Gloss (Red, 20°) Fused |
|---|---|---|---|---|---|---|
| Ropaque HP-543P | Curesan 200 (0.5) | K-210 (10) | 248125 | 301195 | 2.2 | 43.7 |
| HP543/HS3000(75/25) | Curesan 200 (0.5) | Celvol 523 (10) | 246366 | 315086 | 2 | 120.6 |
| HP543/HS3000(25/75) | Curesan 200 (0.5) | Celvol 523 (10) | 220939 | 311354 | 1.8 | 50.9 |
| HS2000 (100) | Curesan 200 (0.5) | Celvol 523 (10) | 252707 | 291592 | 6.1 | 34.9 |

TABLE 2-continued

Formulation and Evaluation of Hollow Particle Receivers for Fusing Study (pigment-based-ink)

| Hollow Particles | X-linker | Binders | Gamut Volume Unfused | Gamut Volume Fused | Gloss (Red, 20°) Unfused | Gloss (Red, 20°) Fused |
|---|---|---|---|---|---|---|
| HS2000/Dow 755 (75/25) | Curesan 200 (0.5) | Celvol 523 (10) | 277483 | 315290 | 5.8 | 52.7 |
| HS2000/HS3000 (50/50) | Curesan 200 (0.5) | Celvol 523 (10) | 220628 | 290455 | 1.7 | 51.7 |

*K-210 is product of Nippon Gohsei Chemicals. Dow 755 is non-hollow latex particles from Dow Chemical Company.

Table 2 illustrates additional formulations of the fusible medium, which were dried overnight and passed through a fusing roller (about 140° C. and 100 PSI at 0.1 in/sec). The gloss and color gamut was measured before and after the fusing (printed with an Epson C80 printer). Table 2 illustrates that embodiments of inkjet medium including hollow plastic particles can be fused very efficiently and both color gamut and gloss were improved significantly by passing through a fusing roller.

EXAMPLE 3

Comparison of Fused and Unfused Hollow Particle Inkjet Media Printed with Dye-Based-Ink:

TABLE 3

Formulation and Evaluation of Fused and Unfused Hollow Particles Inkjet Media Printed with Dye-Based-Ink

| Hollow Particles | Mordants | Binders | Surfactant | Crosslinker | Gamut Volume Unfused | Gamut Volume Fused | Gloss (Red, 20°) Unfused | Gloss (Red, 20°) Fused |
|---|---|---|---|---|---|---|---|---|
| HS-3000 (100) | none | K-210 (10) | Triton X-100 (1) | none | 82466 | 204827 | 0.6 | 29 |
| HS-3000 (100) | none | OKS-6011 (10) | Triton X-100 (1) | none | 85852 | 221686 | 0.6 | 7.7 |
| HS-3000 (100) | Agefloc WT35-VLV (5) | K-210 (10) | Triton X-100 (1) | none | 87332 | 225926 | 0.6 | 30.4 |
| HS-3000 (100) | none | K-210 | none | Curesan 200 (0.5) | 110491 | 289284 | 0.7 | 35.7 |
| Ropaque HP-543P | none | Celvol 523 | none | Curesan 200 (0.5) | 46207 | 228464 | 1.6 | 63 |
| Ropaque HP-543P | none | K-210 | none | Curesan 200 (0.5) | 50236 | 283628 | 2.2 | 43.7 |
| HS-3000 | WC-71 | K-210 | Triton X-100 (1) | none | 75601 | 212210 | 0.6 | 8.4 |

*Agefloc WT35-VLV is poly(DAMAC) from Ciba-Geigy Chemicals, while WC-71 is a cationic acrylic polymer dispersion from PPG.

Table 3 illustrates additional formulations and results of embodiments of the inkjet medium printed with a HP 970 printer (dye-based-ink). To improve water fastness and humid fastness of the dye-based-ink, a cationic mordant is preferably added. Table 3 illustrates that embodiments of the inkjet medium can be fused very efficiently. Both color gamut and gloss of the print imaged with dye based ink improved significantly after passing through a fusing roller under heat and pressure.

Many variations and modifications may be made to the above-described embodiments. All such modifications and variations are intended to be included herein within the scope of this disclosure and protected by the following claims.

At least the following is claimed:

1. A fusible print medium, comprising:

a substrate;

an ink-receiving layer disposed on the substrate, wherein the ink-receiving layer includes a plurality of hollow beads having a diameter from about 0.3 to 5μmeters, a void volume of about 20% to 70%, and a glass transition temperature above 50° C., wherein the hollow beads have substantially the same diameter, and wherein the hollow beads are at least 70% of the ink receiving layer.

2. The fusible print medium of claim 1, wherein the hollow polymer beads have a diameter from about 0.3 to 2 μmeters.

3. The fusible print medium of claim 1, wherein the hollow polymer beads have a void volume of about 30 % to 60 %.

4. The fusible print medium of claim 1, wherein the hollow polymer beads have a glass transition temperature above 70° C.

5. The fusible print medium of claim 1, wherein the hollow polymer beads have a glass transition temperature above 90° C.

6. The fusible print medium of claim 1, where the hollow polymer bead is derived from the monomers selected from acid monomers, non-ionic monoethylenically unsaturated monomers, polyethylenically unsaturated monomer, and combinations thereof.

7. The fusible print medium of claim 1, further comprising non-hollow polymer beads, wherein non-hollow polymer beads are about 0 to 50 % of the ink-receiving layer.

8. The fusible print medium of claim 7, where the non-hollow beads have a glass transition temperature above 50° C.

9. The fusible print medium of claim 8 where the non-hollow polymer bead is derived from the monomers selected from acid monomers, non-ionic monoethylenically unsaturated monomers, polyethylenically unsaturated monomer, and combinations thereof.

10. The fusible print medium of claim 1 further comprising a water soluble cationic mordant, wherein the water soluble cationic mordant includes a cationic polymer, wherein the cationic polymer is selected from a polyethyleneimine; a polyallylamine; a polyvinylamine; a dicyandiamide-polyalkylenepolyamine condensate; a polyalkylenepolyamine-dicyandiamideammonium condensate; a dicyandiamide-formalin condensate; an addition polymer of epichiorohydrin-dialkylamine; a polymer of diallyldimethylammoniumchloride ("DADMAC"); a copolymer of diallyldimethylammoniumchloride-$SO_2$, polyvinylimidazole, polyvinypyrrolidone; a copolymer of vinylimidazole, polyamidine, chitosan, cationized starch, polymers of vinylbenzyltrimethylqammoniumchloride, (2-methacryloyloxyethyl)trimethyl-ammoniumchloride, and polymers of dimethylaminoethylmethacrylate; or a polyvinylalcohol with a pendant quaternary ammonium salt.

11. The fusible print medium of claim 1, further comprising inorganic particles, wherein inorganic particles are 0 to 20 % of the ink-receiving layer.

12. The fusible print medium of claim 11, wherein inorganic particles selected from colloidal silica, fumed silica, precipitated silica, colloidal aluminum oxide, fumed aluminum oxide, boebmite, silica-magnesia, silicic acid, sodium silicate, magnesium silicate, calcium silicate, alumina, alumina hydrate, barium sulfate, calcium sulfate, calcium carbonate, magnesium carbonate, magnesium oxide, kaolin, talc, titania, titanium oxide, zinc oxide, tin oxide, zinc carbonate, pseudo-boebmite, bentonite, hectorite, clay, and mixtures thereof.

13. The fusible print medium of claim 1, wherein the substrate is selected from a paper medium, a photobase medium, a plastic medium, and combinations thereof.

* * * * *

UNITED STATES PATENT AND TRADEMARK OFFICE

CERTIFICATE OF CORRECTION

PATENT NO. : 7,651,216 B2
APPLICATION NO. : 10/963097
DATED : January 26, 2010
INVENTOR(S) : Tienteh Chen et al.

It is certified that error appears in the above-identified patent and that said Letters Patent is hereby corrected as shown below:

On the Title page, in Item (75), Inventors, in column 1, lines 5-7, delete "Loretta Ann Grezzo Page, San Diego, CA (US); Gary O. Page, legal representative, San Diego, CA (US)" and insert -- Loretta Ann Grezzo Page, deceased, late of San Diego, CA (US); by Gary O. Page, legal representative, San Diego, CA (US) --, therefor.

In column 5, line 67, delete "vinylbenzyltrimethylqammoniumchloride" and insert -- vinylbenzyltrimethylammoniumchloride --, therefor.

In column 13, line 21, in Claim 10, delete "epichiorohydrin" and insert -- epichlorohydrin --, therefor.

In column 14, line 1, in Claim 10, delete "polyvinypyrrolidone" and insert -- polyvinylpyrrolidone --, therefor.

In column 14, line 3, in Claim 10, delete "vinylbenzyltrimethylqammoniumchloride" and insert -- vinylbenzyltrimethylammoniumchloride --, therefor.

In column 14, line 13, in Claim 12, delete "boebmite" and insert -- boehmite --, therefor.

In column 14, line 18, in Claim 12, delete "boebmite" and insert -- boehmite --, therefor.

Signed and Sealed this

Twenty-ninth Day of June, 2010

David J. Kappos

David J. Kappos
*Director of the United States Patent and Trademark Office*